United States Patent [19]

Kuehfuss

[11] Patent Number: 4,558,615

[45] Date of Patent: Dec. 17, 1985

[54] METHOD FOR THE MANUFACTURE OF FRESHLY PRINTED SECURITY PAPERS CUT TO FORMAT AND AUTOMATIC CUTTING MACHINE FOR CARRYING OUT THE METHOD

[75] Inventor: Runwalt Kuehfuss, Metzingen, Fed. Rep. of Germany

[73] Assignee: De La Rue Giori S.A., Switzerland

[21] Appl. No.: 481,332

[22] Filed: Mar. 29, 1983

[30] Foreign Application Priority Data

Apr. 8, 1982 [CH] Switzerland ..... 2194/82

[51] Int. Cl.[4] ..... B26D 5/00

[52] U.S. Cl. ..... 83/74; 83/367; 83/408

[58] Field of Search ..... 83/367, 368, 408, 74, 83/371

[56] References Cited

U.S. PATENT DOCUMENTS

| | | | |
|---|---|---|---|
| 2,266,759 | 12/1941 | Huck | 83/367 |
| 2,735,055 | 2/1956 | Thomas | 83/367 |
| 3,289,507 | 12/1966 | Grewe | 83/74 |
| 3,407,690 | 10/1968 | Stanley | 83/367 |
| 4,065,991 | 1/1978 | Benuzzi | 83/408 |
| 4,283,902 | 8/1981 | Giori | 53/520 |

FOREIGN PATENT DOCUMENTS

| | | | |
|---|---|---|---|
| 2757186 | 7/1978 | Fed. Rep. of Germany . | |
| 2265652 | 10/1975 | France . | |
| 2461055 | 3/1981 | France | 83/368 |
| 1008102 | 10/1965 | United Kingdom . | |
| 1065643 | 4/1967 | United Kingdom . | |

*Primary Examiner*—Lowell A. Larson

*Attorney, Agent, or Firm*—Kane, Dalsimer, Kane, Sullivan and Kurucz

[57] ABSTRACT

Piles of sheets (S5) consisting of sheets of security papers (10), are cut into layers of strips (18) and then into bundles of security papers (19). The lengths of the feed movements of the feed device (26), are controlled by a reading unit (29) provided on the strip-cutting unit (27). The reading unit reads an edge mark which was printed during printing of the sheets in the printing machine (20) by the printing plate on a side edge of the sheet. The side edge of the sheet is cut off at a later time and orientated parallel to the feed direction of the pile of sheets, when cutting strips. Edge marks read by the reading unit are provided on the printing plate and necessarily follow the expansion of the printing plate increasing in the course of operation, which in particular at the time of die-stamping, is considerable on account of the high contact pressure. An automatic control of the feeds between successive cuts is achieved in this way so that centering of the printed image on the security papers relative to the unprinted edge of the security paper is maintained substantially more accurately than was previously the case, despite increasing expansion of the printing plate.

19 Claims, 6 Drawing Figures

Figure 1:
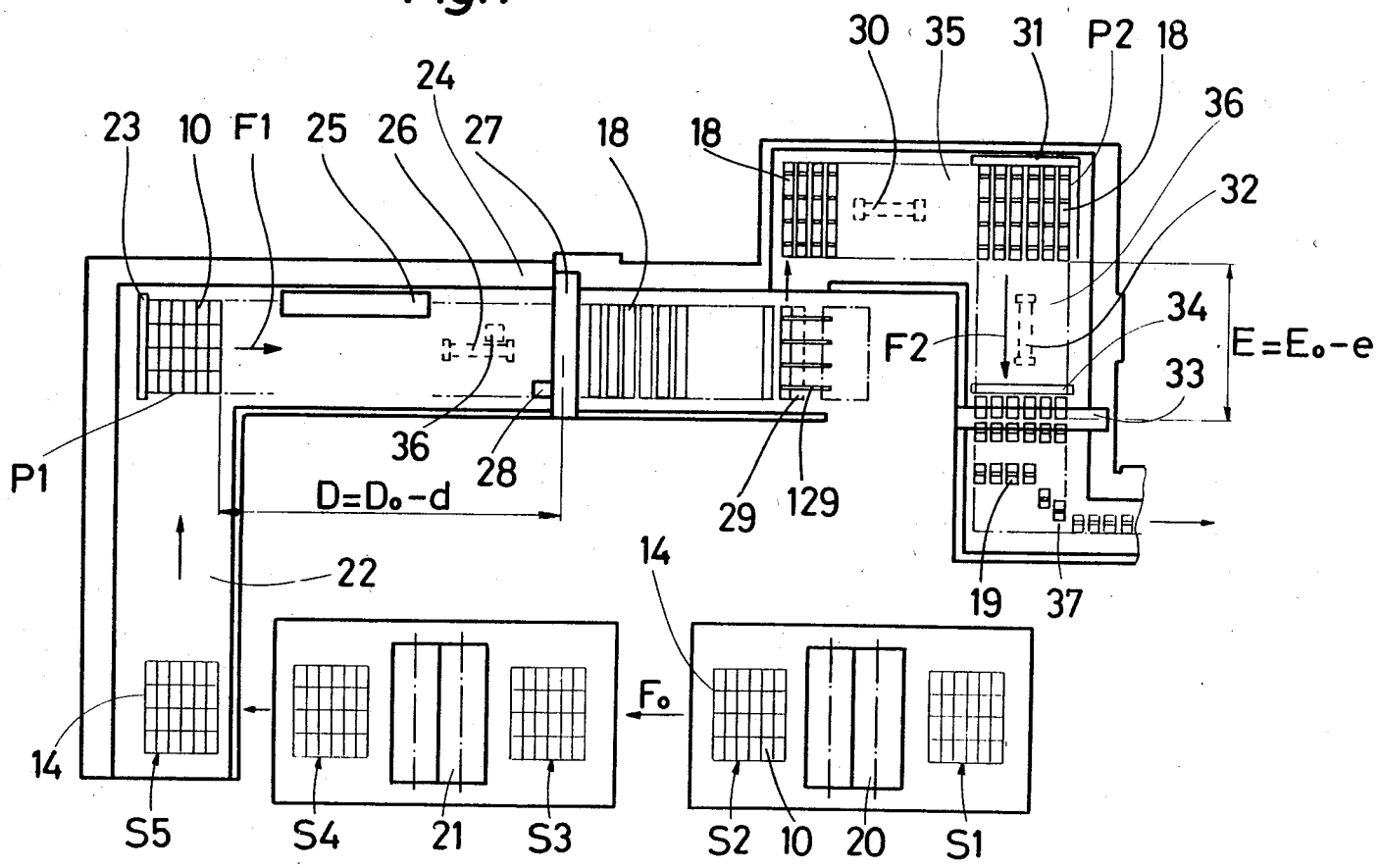

METHOD FOR THE MANUFACTURE OF FRESHLY PRINTED SECURITY PAPERS CUT TO FORMAT AND AUTOMATIC CUTTING MACHINE FOR CARRYING OUT THE METHOD

The invention relates to a method for the manufacture of freshly printed security papers out to format and to an automatic cutting machine for carrying out the method.

In the manufacture of security papers, in particular of bank-notes, generally sheets of security papers with a certain number of individual units, that is to say with a certain number of security paper impressions arranged in the form of a matrix are first of all produced and then these sheets are cut in the form of a pile step by step into layers of strips and then the layers of strips are cut into bundles of security papers, in which case the individual security papers of the bundle obtain their finished format. When using cutting machines operating automatically, the feed lengths for the step-wise feeding of the pile of sheets and of the layers of strips is fixed on the basis of a feed programme which is pre-set once and in particular depending on the size of security paper or the desired security paper format. The finished, cut security papers which are produced are therefore naturally all the same size. This uniform size of security paper is advantageous for automatic processing, sorting and packing of the bundles of security papers.

However, for aesthetic reasons and also for reasons of preventing forging, it is now desirable that the printed image of a security paper is always centred within the borders of the security paper or, as one says, lies exactly in the frame. Hitherto, this condition could not always be fulfilled exactly if printing of the security paper includes direct photogravure printing, in particular die-stamping, in which the printing plates are subjected to a very high contact pressure and under the action of these forces, in the course of the operation, experience a gradual expansion, that is to say they become increasingly longer and also wider, in which case this enlargement along the printing plate becomes greater in the direction opposed to the direction of rotation of the plate cylinder. The diagrammatic shape of a printing plate deformed in this way, which is approximately trapezoidal, corresponds to the outline 11' in FIG. 2 which will be described in detail hereafter. In accordance with the elongation and widening of the printing plate, the size and positions of the imprints vary, so that with automatic cutting of the pile of sheets comprising constant feed lengths, finished, cut security papers are produced in which as the number of imprints increases, the printed image is displaced to an increasing extent from its centred position and therefore the difference in the widths of the margins becomes increasingly more conspicuous.

It is the object of the invention to provide a method which despite any deformation of the printing plates occurring during operation, makes it possible, when cutting up the piles of sheets, to obtain constantly security papers which have printed images centred at least approximately with regard to the margins of the security papers.

This object is achieved according to the invention providing lengths of feed movements between successive strip cuts or bundle cuts which are varied individually depending on the increasing expansion of the printing plate and, as regards the cutting machine for carrying out the method according to the invention, by the features described in patent claim 15.

The variation of the feed lengths can be carried out in the simplest manner by hand on the basis of an experimental programme, which was established for the respective printing plates empirically and possibly also theoretically. One thus begins with readjustment of the feed lengths, as soon as the deformation of the printing plates has reached an extent which in practice is troublesome, which may be the case for example after 50,000 to 100,000 imprints. After a further 50,000 to 100,000 imprints, the lengths of the feed movements may again be changed and adapted accordingly. The readjustments of the original feed programme to be made may take place on the basis of a regular inspection and measurement of the printed plate, for example after 50,000 or 100,000 imprints.

It is also possible to control the feed lengths automatically by a computer on the basis of a programme prepared for each type of printing plate, which varies with an increasing number of printing operations.

Changing the lengths of the individual feed operations can be carried out particularly accurately and simply with commercially available feed devices, which are known by the name linear amplifiers. These linear amplifiers have a hydraulic cylinder/piston system, in which case the metered supply of pressure medium to the hydraulic cylinder takes place by means of a stepping motor, which opens the pressure medium inlet valve for a short time upon each revolution. Due to this, upon one revolution of the stepping motor, an exactly metered, small quantity of pressure medium is supplied to the cylinder so that the piston carries out a feed of 0.1 mm for example. A feed controlled hydraulically in this way also operates with a sufficiently short response time.

A preferred manner of carrying out the method according to the invention consists of applying to the printing plate printing marks, which define the subsequent cutting lines and necessarily follow the deformations of the printing plate and of controlling the feed devices by reading units, which read the marks applied during the printing operation. These marks are printed on the edges of the sheets and if necessary on the regions located between the printed images, which are cut off as waste strips at the time of subsequent trimming of the sheets or at the time of subsequent intermediate cuts. In this way, the cutting machine can be controlled automatically as a function of the position of the printed marks so that security papers are always cut whereof the printed image is centred correctly or at least substantially more accurately than previously.

If one dispenses with intermediate cuts, changing the feed lengths during cutting naturally has the result that irrespective of the deformation of the printing plates, the finished, cut security papers vary slightly as regards their size. However, the advantage achieved, namely that the printed image of the security papers always lies at least approximately exactly in the frame, is valued substantially more than the slightly different sizes of the security papers produced. This varying size is in practice on the whole not noticeable and if need be could be ascertained by exact measuring of several security papers. Also, the slightly different sizes of security papers in practice is not of great importance at the time of their further processing to form wrapped packs of bundles. On the other hand, a printed image which is not correctly centred is immediately obvious to a person looking at a security paper.

However, if one attaches importance to the fact that all security papers should have the same constant format, then naturally one can work with intermediate cuts, which involves a somewhat more complicated method. In this case, the waste strips must generally have a width of at least approximately 2 mm, in order that troublefree cuts can be made.

Generally, the deformation effect of the printing plate is more considerable in the longitudinal direction than in the transverse direction, so that under certain circumstances, it is necessary to alter the feed lengths solely when cutting strips parallel to the gripper edge and when cutting bundles, a centering correction can be dispensed with. However, it is also conceivable that in certain cases, only one centering correction is made when cutting bundles and when cutting strips, one works with fixed feed lengths.

Figure 2:
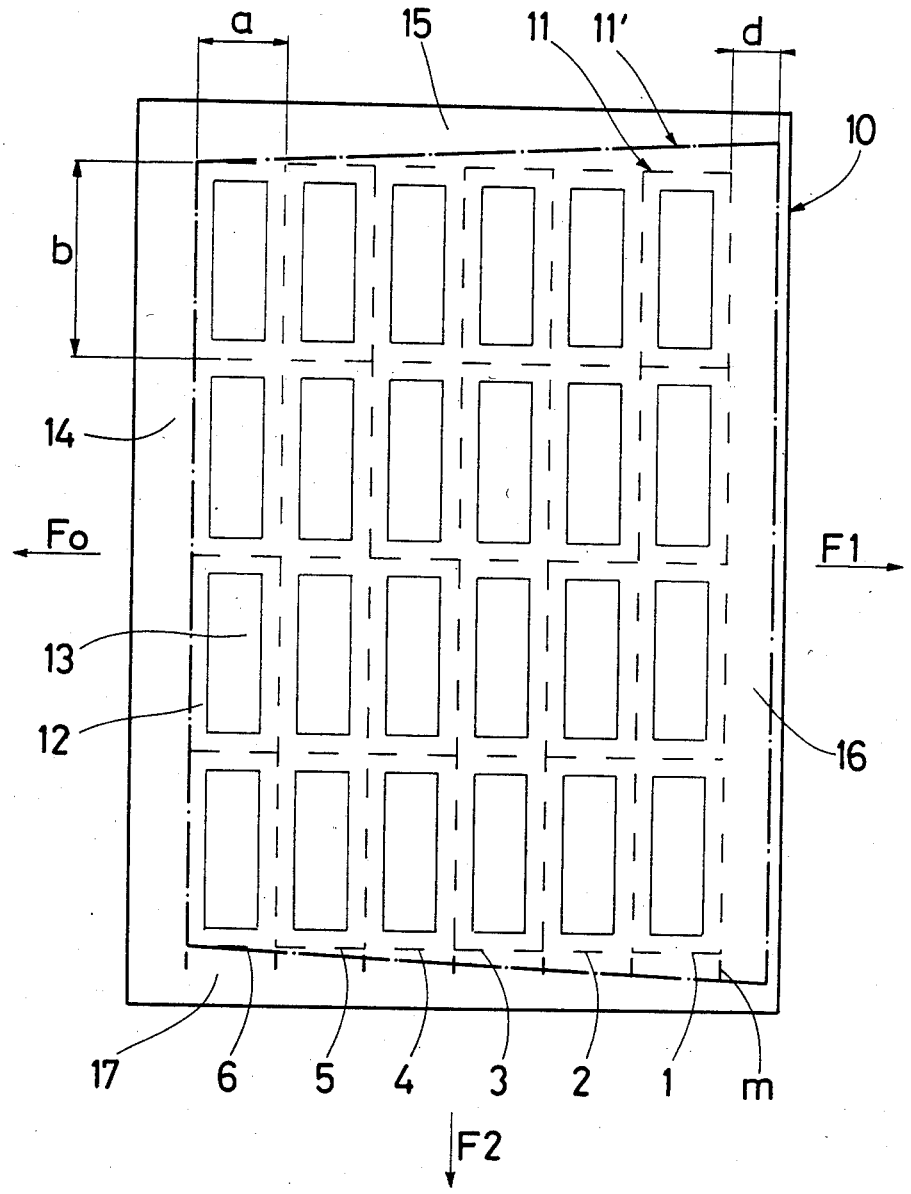
Figure 3:
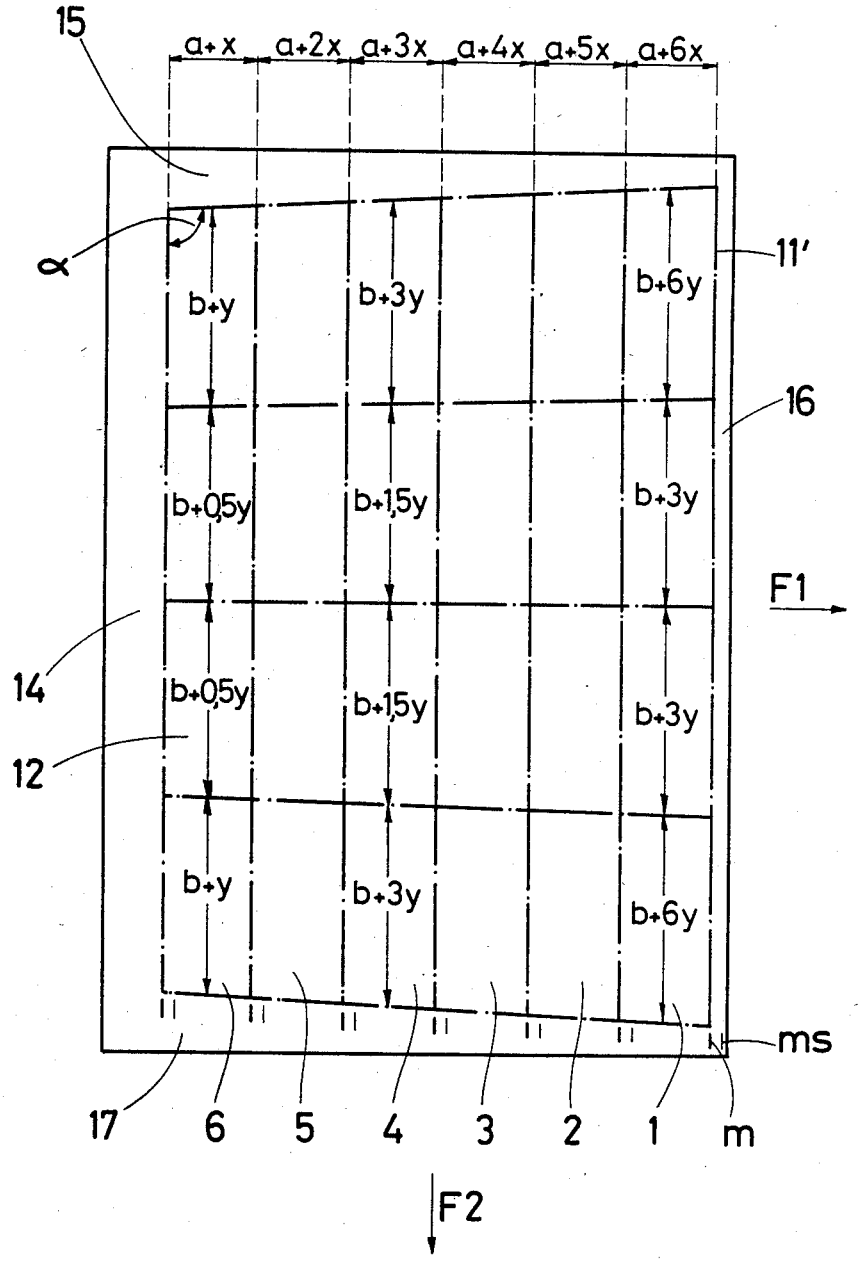
Figure 4:
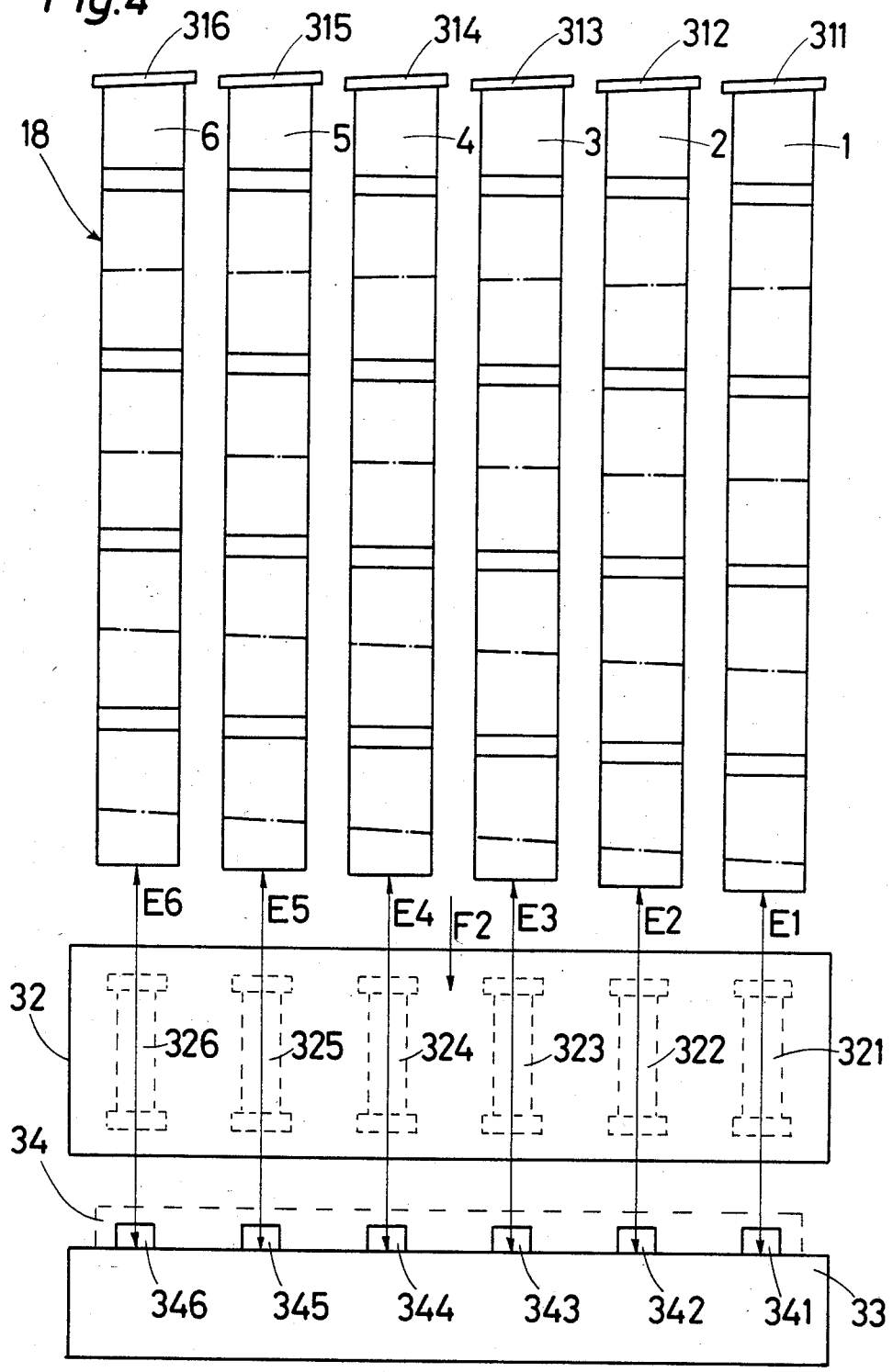
Figure 5:
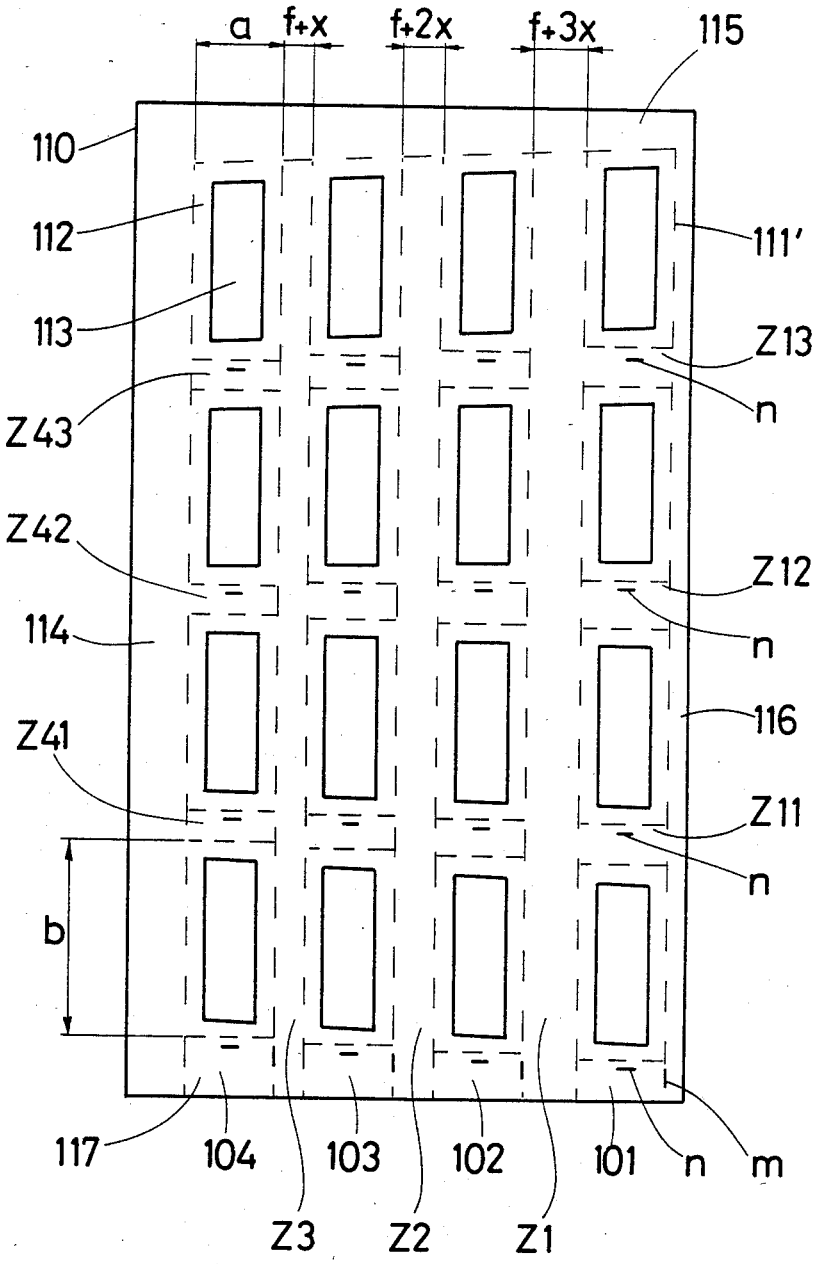
Figure 6:
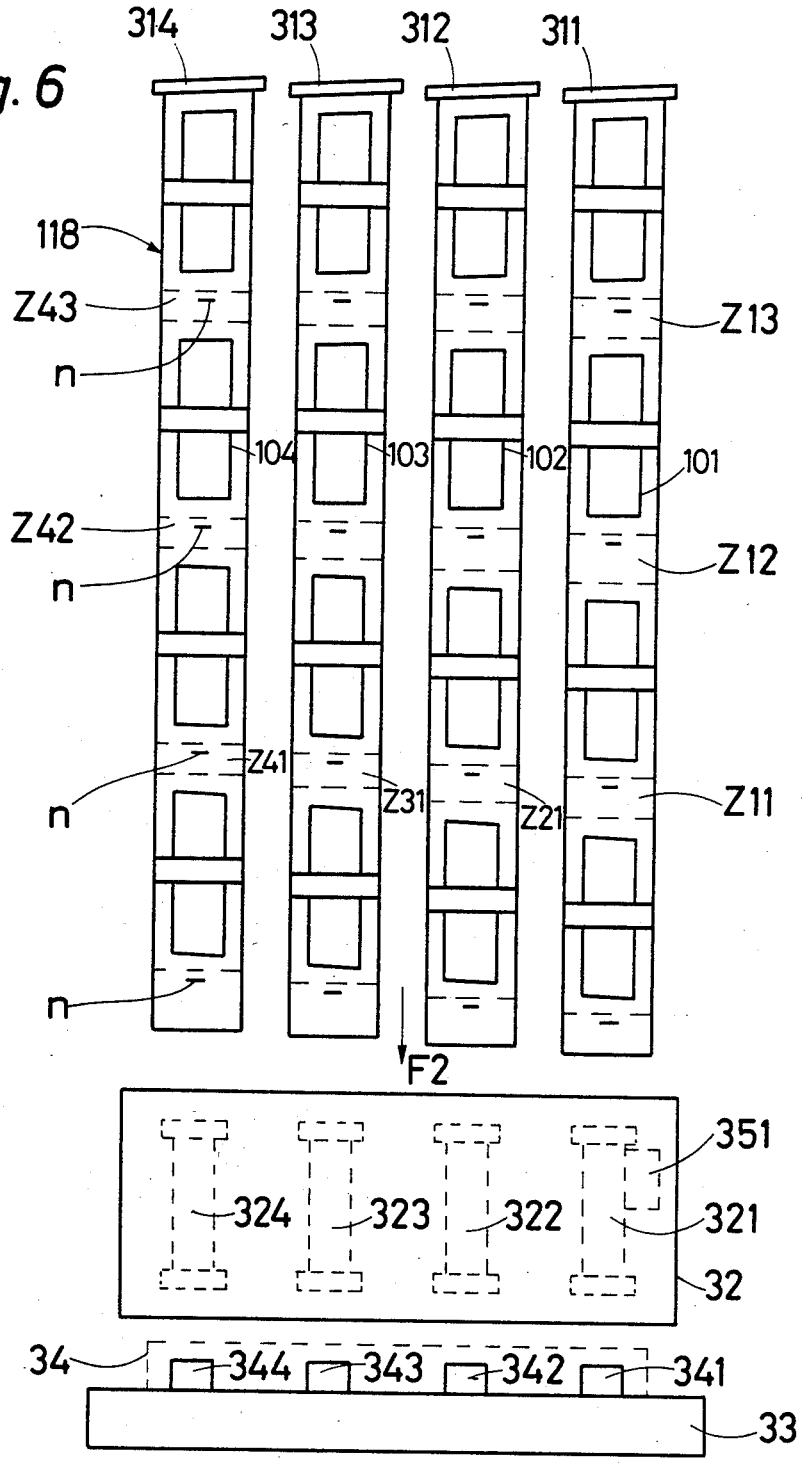

The invention is described in detail with reference to the drawings, in which:

FIG. 1 is a diagrammatic view of the essential processing stations in the manufacture of security papers according to the present invention, FIG. 2 is a diagrammatic view of a sheet of security papers printed with a new, undeformed printing plate, which sheet comprises $6\times4=24$ security paper imprints or individual notes and on which the subsequent cutting lines are shown in broken line; the approximately trapezoidal outline of the distorted total printed image of all security paper imprints is shown in dot dash line, as produced by a printing plate which has expanded in a corresponding manner after numerous printing operations, in which case the distortion, as in the following figures, is shown in an exaggerated manner for the sake of easy illustration and is not true to scale, FIG. 3 shows the sheet according to FIG. 2 with the distorted total printed image and the subsequent cutting lines shown in dot dash line, the positions of which are corrected on the basis of the changes of the feed lengths, FIG. 4 shows the region including the bundle-cutting unit according to FIG. 1, with the six layers of strips in diagrammatic, enlarged illustration with the associated feed devices, FIG. 5 shows a sheet comprising $4\times4=16$ security paper imprints, with a distorted printed image, which is processed using intermediate cuts and on which the subsequent cutting lines are shown by broken line and FIG. 6 is an illustration corresponding to FIG. 4, which illustrates the feed of four layers of strips of the sheet according to FIG. 5, at the time of cutting bundles.

FIG. 1 shows diagrammatically those processing stations, at which stages of the method according to the invention are carried out. It is assumed that the sheets of security papers have already been printed on both sides by offset printing and also on one side by die-stamping. The last printing operation for the sheets of security papers prepared in this way consists in that the other side of the sheet is also printed by die-stamping. The die-stamping unit 20 provided for this is shown diagrammatically in FIG. 1. The sheets of security papers, which lie ready at the inlet of the die-stamping unit 20 in the form of an inlet pile S1, pass in known manner individually in succession through the die-stamping unit 20 and at its outlet are collected as an outlet pile S2. As shown, the individual, finished printed sheets 10 each have twenty four security paper imprints or so called individual notes, which are arranged in the form of a matrix in six rows each with four security paper imprints. FIG. 2 is an enlarged view of a sheet 10 of this type with its six rows of security papers 1 to 6. The security papers subsequently cut to format are designated by the reference numeral 12 and the actual security paper imprints surrounded by an unprinted border are designated by the reference numeral 13.

As is known, on passing through the printing units, the individual sheets are pulled by sheet grippers, which retain the front edge of the sheet. This edge of the sheet located at the front on travelling through the printing units in the conveying direction $F_o$ is the so called gripper edge 14 (FIGS. 1 and 2) and the rows of security papers 1 to 6 are oriented parallel to this gripper edge 14, i.e. at right angles to the direction of travel of the sheets through the printing units. The three other edges of the sheets are referred to by the reference numerals 15,16 and 17.

The finished, printed sheets 10 of the pile S2 are normally subjected to a visual quality control, in which sheets with faulty printing are eliminated and then for the purpose of numbering of the individual notes are fed from an inlet pile S3 into a numbering machine 21 and at the outlet of the latter are deposited on an outlet pile S4.

Then, the numbered sheets are supplied in the form of a pile in succession to an automatic cutting machine. For this purpose, according to FIG. 1, a pile of sheets S5 is first of all conveyed in the direction of the arrow along a conveying section 22 to the inlet of a cutting section 24 and brought into a definite initial position P1, in which all the sheets 10 of the pile are aligned with their gripper edges 14 against a stop 23. During the subsequent transportation of the pile along the cutting section 24 in the direction of arrow F1 to the strip-cutting unit 27 and during the step-wise feed within this strip-cutting unit 27, the gripper edges 14 form the rear edges of the sheets and thus the reference edge of the pile of sheets which is critical for cutting strips, bearing on which reference edge, in known manner, are finger-like slides of an automatic feed device 26, in order to move the pile forwards.

Located laterally on the cutting section 24, in front of the strip-cutting unit 27, is a longitudinal cutting unit 25, against which the piles are stopped and in which trimming of the side edge takes place. At this point, the edge of the sheet is trimmed, which at the time of subsequent cutting of bundles forms the rear edge of the layers of strips, which in the example in question is the side edge 15 of the sheets 10 on the left-hand side in the feed direction. Then, in the strip-cutting unit 27 constructed as a cross-cutting unit, trimming of the front edge 16 of the sheets 10 takes place first of all on the front side of the pile (FIG. 2), then, the pile is cut step-wise by one cut respectively into its six layers of strips 18, which correspond to the six rows of security papers 1 to 6 and finally on the rear side of the last layer of strips, rear trimming of the gripper edge 14 is carried out. The waste paper produced at the time of trimming drops through a waste flap. When a pile has been cut, the next pile is supplied automatically.

Located after the strip-cutting unit 27 is a banding station 29 with a number of individual banding devices, in the example in question four banding devices, corresponding to the number of individual units per strip, which devices are operated simultaneously at the time of each working operation so that each layer of strips 18 is surrounded simultaneously at the four security paper or note positions respectively with a pre-glued band 129.

The finished, bound layers of strips 18 are first of all removed from the banding station 29 in the direction of the arrow, in the longitudinal direction of the strips and then moved along the conveying section 35, at right angles to the longitudinal direction of the strips, by means of a feed device 30 to the inlet of the cutting section 36, on which an automatic bundle-cutting unit 33, constructed as a cross-cutting unit, is installed. At the inlet of this cutting section 36, all six layers of strips 18 belonging to one and the same pile of sheets S5 are assembled in a definite initial position P2, in which the edges cut in the longitudinal cutting unit 25 are aligned by bearing against a stop, which is formed by the slide system 31 of the feed device 32. Whereas in previously known installations, a single feed device with a slide, common to all layers of strips, is provided, the feed device 32 according to the invention consists, as described hereafter, of a number of individual feed devices corresponding to the number of layers of strips 18 per pile, with slides moving the layers of strips individually. All six layers of strips 18 belonging to a pile of sheets, which, as shown in FIG. 1, are arranged at a small distance apart, are then moved together by means of the feed device 32 in the direction of arrow F2 to the bundle-cutting unit 33, in which case they are guided in grooves. In the bundle-cutting unit 33, first of all the front edge of all layers of strips 18 corresponding to the side edge 17 of the sheets (FIG. 2) is cut and then all six layers of strips 18 are cut step-wise simultaneously by three successive cuts into individual bundles 19 of security papers, which are already bound and in which the security papers have their finished format. At the time of these feed movements, the cut, rear edges form the reference edges which are critical for cutting bundles, against which edges the slides of the feed device 32 bear.

The aforedescribed processing of sheets of security papers to form bound bundles of security papers and the cutting and binding machines used for this are known and described for example in Swiss Patent Specification CH No. 612 639 or U.S. Pat. No. 4,283,902 of the same applicant, as well as in the former Swiss Patent Specification No. 6 740/81 of the same applicant.

The bound bundles 19 cut to format are moved forwards on a conveying section 37 and arrive at further processing stations which are not of interest in this case, in which packs of bundles with consecutively numbered security papers of a certain series are formed and then the packs of bundles are bound and wrapped. This further processing is the subject for example of Swiss Patent Specification CH No. 577 426 or U.S. Pat. Nos. 3,939,621 and 4,045,944 of the same applicant.

Apart from the use of individual feed devices for the feed of the individual layers of strips, in the cutting machine described with reference to FIG. 1, a further difference with regard to the known prior art consists in that for reasons which will be described hereafter, only one longitudinal cutting unit 25 is provided for trimming one side edge of the sheets and the trimming on the opposite side solely takes place in the bundle-cutting unit, whereas it is known and customary, instead of one longitudinal cutting unit, to provide two opposite longitudinal cutting units in front of the strip-cutting unit 27, which longitudinal cutting units cut each pile to format simultaneously on both opposite side edges.

Hitherto, all the feed lengths or feed steps, which when cutting strips and cutting bundles determine the exact cutting lines, are fixed once and for all for the type of sheet respectively processed and are pre-set at the automatic feed devices before the beginning of the processing operation, depending on the given format of sheet and security paper and the number of units, which feed devices can be electronically programmed for this purpose. The following belong to these fixed, pre-set values:

the distance $D=D_o$ between the initial position P1 of a pile and that position of the pile in the strip-cutting unit 27, in which trimming of the front edge takes place;

the feed steps, taking place between successive cutting of strips, which are equal to the width a of a security paper 12;

the distance $E=E_o$ between the initial position P2 of the layers of strips 18 and their position in the bundle-cutting unit 37, in which the aforementioned trimming of the front edges of the layers of strips takes place and the feed steps taking place between successive cutting of bundles, which each have the length b of a security paper 12.

According to the definitions $D=D_o-d$ and $E=E_o-e$ given in FIG. 1, as long as the corrections d and e discussed hereafter are zero or are not taken into consideration, the aforementioned distances thus have the fixed values $D=D_o$ and $E=E_o$.

Also, according to the present invention, as long as the die-stamping plates used are new and have not experienced any considerable expansion, one works with the originally pre-set, constant feeds $D_o$, a, $E_o$, and b. As long as no appreciable expansion of the die-stamping plates occurs, the contour 11 of the total printed image shown in FIG. 2 (including the subsequent edges of the security paper), according to the exact original geometry and arrangement of the recesses of the printing plates, is exactly rectangular and the security paper imprints 13 likewise shown in FIG. 2 as rectangular are all undistorted and of the same size and after the sheets 10 have been cut along the cutting lines shown in broken line, into security papers 12 with the same format $a \times b$, are always centered with respect to the unprinted border of the security paper.

In the course of operation, the printing plates expand under the action of the contact forces, which are exerted at the time of each printing operation by the printing cylinders. This deformation is particularly considerable in the case of a die-stamping plate, because it is necessary to operate with particularly high pressure for die-stamping printing. In the case of this printing plate deformation, the elongation and widening takes place in a non-linear manner, so that the printing surface assumes an approximately trapezoidal shape, in which case the rear edge of the printing plate seen in the direction of rotation of the plate cylinder forms the base side of the trapezium. Accordingly, the outline 11', which limits the surface of the total printed image of all security paper imprints of a sheet 10 and is illustrated in dot dash lines in FIG. 2, as well as each individual security paper imprint is distorted approximately in a trapezoidal shape.

In the example according to FIG. 2, the total printed image is lengthened by the amount d in the direction F1 with respect to its original dimension, which amounted to 6a.

A sheet 10, whose printed image is distorted in this way and has the contour 11', is shown in FIG. 3. Also shown in FIG. 3, in broken line, are those lines which are intended to form the cutting lines at the time of subsequent cutting into strips and bundles, in order that despite the distortion, in all security papers produced, the security paper imprints (not shown in FIG. 3) lie at least approximately in the frame, i.e. are centered with respect to the unprinted border of the security paper.

The feed control described hereafter with varying feed lengths according to the invention now makes it possible to cut each sheet along these "desired cutting lines", which thus define the corrected dimensions of the security papers.

In the example according to FIG. 3, an expansion condition of the printing plate is assumed, with which the dimensions of the individual rows of security papers 6 to 1 increase successively in the direction F1. Thus, the width of the row of security papers 6 adjacent the gripper edge 14 has increased from the original value a by an amount x to the value a+x, that of the row of security papers 5 to the value a+2x and that of the following rows of security papers 4 to 1 to the values a+3x, a+4x, a+5x and a+6x. The total elongation in the direction F1 thus amounts to 21x, which is equal to the amount d shown in FIG. 2. Naturally, in practice, these extensions are not necessarily integral multiples of the increase x of the row of security papers 6 distorted least, as was assumed in this case by way of example, for the sake of simplicity.

The dimensions of the individual units (i.e. of the security paper imprints including their unprinted border) orientated in the direction F2, i.e. parallel to the gripper edge 14, first of all decrease along each of the rows of security papers 1 to 6, beginning with a value increased with respect to the original dimensions b and then once more increase and then become successively larger from one row of security papers to another, seen in the direction F1. In the example under consideration, the individual units located at the ends of the row of security papers 6 have a dimension b+y increased by the amount y, whereas the two middle individual units are elongated solely to b+0.5. In the row of security papers 5, the two individual units located at the ends have the dimension b+2y and the two middle units the dimension b+y. In the row of security papers 4, the two individual units located at the ends have the dimension b+3y and the two middle units the dimension b+1,5y. In the following rows of security papers 3, 2 or 1, the outer individual units accordingly have the dimensions b+4y, b+5y or b+6y and the middle units have the dimensions b+2y, b+2,5y or b+3y.

With a sheet size of approximately 500×750 mm, after 100,000 printing operations, the values x and y may amount for example to approximately 0.05 mm, so that the elongation d of the total printed image of a sheet (FIG. 1) totals approximately 1 mm. If the cutting of the pile of sheets takes place as previously with constant feed lengths, that is to say along the lines shown in broken line in FIG. 1, then in the middle region of the row of security papers 6, in practice the printed image 13 of the security papers 12 is still centred within the unprinted border of the security paper, whereas all the other security papers have a printed image shifted to a greater or lesser extent from its central position, in which case these centering errors are greatest for the security papers of the row 1 of security papers and naturally become greater and more conspicuous as the number of printing operations increases.

In order to avoid these centering errors, the individual feed lengths are now altered both when cutting strips in the direction F1 as well as when cutting bundles in the direction F2, according to the aforediscussed distortion values.

The correction when cutting strips will firstly be considered. In order to achieve a fully automatic control of the feed varying when cutting strips, according to a first preferred manner of carrying out the method according to the invention, printed marks are provided on the die-stamping plate, which marks define the subsequent cutting lines and necessarily vary their position with increasing expansion of the printing plate. When printing the sheets 10 in the die-stamping unit 20, these marks are also applied to one side edge 17 of each sheet and in the example in question (FIGS. 2 and 3) consist of dash-like marks m, which are associated with the cutting line parallel to the gripper edge 14. Directly before the pile of sheets enters the strip-cutting unit 27, these marks are read directly by a reading unit 28 (FIG. 1), which stops the pile of sheets in the cutting position provided.

The distance of the reading unit 28 from the cutter of the strip-cutting unit 27 and the positions of the marks m relative to the cutting lines associated therewith are chosen so that after the feed device 26 is stopped, when the reading unit 28 responds, on account of its inertia and the inertia of the feed mechanism, a pile of sheets still moves into the desired cutting position and comes to rest at this point. This stopping distance or deceleration distance of a pile is a definite quantity which can be reproduced exactly for similar piles. Thus, the first mark m in the feed direction F1 ensures that a pile automatically covers exactly the feed length $D=D_o-d$, in which case d becomes greater as the expansion of the printing plate increases, so that the width of the front edge 16 of the sheet cut off at the time of the first cut becomes correspondingly less in the course of operation. In each case, the following marks m exactly control the sequence of feed steps becoming successively smaller, that is to say in the example according to FIG. 3 the feed steps a+6x, a+5x, etc., to a+x.

The marks to be printed, which are simple to produce and their automatic reading by a reading unit 28 controlling the feed device 25 therefore allow a continuous exact control of the feed lengths when cutting strips, as a function of the constantly increasing deformation of the printing plates. At the start of the cutting operations in the cutting machine, it must solely be ensured that the side edge 17 of the sheet comprising the marks m is cut off only after cutting into strips, which in the example in question takes place in the bundle-cutting unit 37 by trimming the front edge.

Instead of single marks, double marks may also be provided, which, as shown in FIG. 3, consist of two dash-like marks $m_s$ and m located at a short distance apart. The arrangement is then such that on reading the first mark $m_s$, the normal feed speed of the pile of sheets is reduced to a creeping movement and only on reading the respective second mark m is the feed device stopped. The preceding slowing-down of the pile of sheets before it stops in this way increases the arrival accuracy in the cutting position and is appropriate if the piles of sheets are moved forward in the conventional manner, as described, by means of slides, which bear solely on the rear edge of the pile.

As a function of the increasing expansion of the printing plates, the control of the feed when cutting bundles is somewhat more complicated than when cutting strips, because not only the four individual units belonging to one row of security papers have different lengths within one layer of strips, but also within one group, the six layers of strips belonging to the same pile become longer in the direction F1 from one layer of strips to another, as was already described with reference to FIG. 3. Therefore, the feed movements of the individual layers of strips 18, at the time of their simultaneous feed to the bundle-cutting unit 33 and between the successive bundle cuts, must be different. In order to achieve this, as shown diagrammatically in FIG. 4, the feed device 32 consists of a number of separate, independently controllable feed devices 321 to 326, corresponding to the number of layers of strips per pile, whereof each device with its associated slide 311 to 316 moves one of the layers of strips 18 individually, which correspond to the rows of security papers 1 to 6. These slides 311 to 316 thus replace the hitherto known slide which was common to all layers of strips and form the slide system 31 mentioned in the description of FIG. 1.

Since, in the example under consideration, the rear edges of the layers of strips 18 are already cut to their final format at the time of trimming the sides in the longitudinal cutting unit 25, this trimming of the side edge does not take place exactly always at a right angle to the gripper edge 14 (FIG. 1), but rather along the line of the trapezoidal outline 11' of the total printed image defining the side edge 15. With the gripper edge 14, this cutting line encloses the angle $\alpha$ (FIG. 3) which as the distortion begins is greater than 90° and increases as the expansion of the printed plate increases. For this purpose, the longitudinal cutting unit 25 or its cutter is able to rotate about a vertical axis so that starting from an original right angle, the cutting angle $\alpha$ relative to the gripper edge 14 can be made increasingly larger in the course of operation. According to this cutting angle $\alpha$, the slides 311 to 316 of the feed devices 321 to 326 are also adjusted to have an increasing inclination in the course of operation, in order that they are always orientated parallel to the rear edge of the layers of strips 18 and thus bear flush against the latter, in order to ensure a well-defined feed. For this purpose, the slides 311 to 316 are able to tilt about vertical axes within an adequate angle.

Various possibilities of how this cutting angle $\alpha$ of the longitudinal cutting unit 25 can be controlled automatically, are described hereafter. At this point it is assumed that the cutting angle is varied depending on the increasing distortion, as mentioned, which in the simplest case can be carried out by hand so that after the passage of 50,000 to 100,000 sheets for example, corresponding to 500 to 1000 piles each with 100 sheets, on the basis of a visual inspection and measuring of the printed images or of the expanded printing plate, the cutting angle is reset.

For controlling the feed of the layers of strips 18, when cutting bundles, in general no special printed marks can be used, because the latter must not be printed on margins which are cut off subsequently, but in the regions of the security papers, which as a rule is not acceptable. Solely the first cutting position for trimming the front edge of the layers of strips could be defined by marks, which like the marks m for cutting strips, are applied to the edge 17 of the sheet. Thus, it is provided according to a first preferred way of carrying out the method according to the invention to select a characteristic position located in the vicinity of the cutting line to be produced, on the respective security paper imprint, to which a reading unit responds selectively. In this case it may be a local pattern, a certain area of colour or a distinctive contrast, preferably the contrast between the light, unprinted border of the security paper and a dark region of the security paper imprint. Such a characteristic point, in particular a sufficient contrast on the boundary of the security paper imprint can be found in practice in all security papers and used as a natural mark which can be recognized selectively by a reading unit, which defines the adjacent cutting line. Reading units with the necessary selectivity are readily available with the high degree of development of photoelectric appliances or can be easily adapted. In order to guarantee the unambiguity of the reading, in known manner one can work with reading windows, such as occurs for example when reading registered marks in printing machines. The characteristic points to be read for controlling the feed movements may also be fluorescent areas provided on the security paper. Furthermore, for these characteristic points, it may be a question of non-optical properties, for example of metal threads or the like embedded in the security paper, to which suitable detectors respond.

It is assumed that serving as a mark for the feed control when cutting bundles is the contrast between the light border of the security paper located at the front in the direction F2 and the dark printed image of each individual unit on each of the layers of strips 18. For recognizing this contrast, a reading unit system 34 with six reading units 341 to 346 is installed in front of the bundle-cutting unit 33 (FIG. 4), which reading units individually scan the individual layers of strips 18, corresponding to the six rows of security papers 1 to 6 and individually control the feed devices 321 to 326 respectively moving these layers of strips. Starting from the aligned initial position P2, the six layers of strips 18 are moved forwards together, which on account of the slightly inclined trimming on their rear edges, are of different lengths, as shown in FIG. 4.

On account of this varying length and on account of the printed image distortion, the reading unit 341 responds firstly to the first contrast point of the layer of strips corresponding to the row of security papers 1, that is to say to the front boundary of the first security paper printed image and therefore stops the feed device 321. The arrangement is such that as a result after a total feed length E1 the layer of strips comes to rest in the first desired cutting position, in which the front edge of the layer of strips is cut. The feed lengths of the remaining layers of strips controlled accordingly by the reading units 342 to 346, which correspond to the rows of security papers 2 to 6, increase successively and are designated in FIG. 4 by the references E2,E3,E4,E5 and E6. In this case, generally $E_i = E_o - e_i$, in which case the index i relates to one of the six rows of security papers 1 to 6 and may assume the value 1 to 6 accordingly. For $i=1$, i.e. the layer of strips corresponding to the row of security papers 1, in the example under consideration according to FIG. 3, $e_1=18y$, $e_2=15y$, $e_3=12y$, $e_4=9y$, $e_5=6y$ and $e_6=3y$.

Only when all six layers of strips 18 have assumed their desired cutting position does simultaneous trimming of the front edge take place in the bundle-cutting unit 33. The following successive feed steps are controlled by the reading units individually for each layer of strips so that they have the lengths shown in FIG. 3 and already discussed, namely for the layer of strips corresponding to the row of security papers 1 the lengths b+6y, b+3y, b+3y and b+6y. For the other layers of strips corresponding to the rows of security papers 2 to 6, the lengths of these feed steps decrease, as shown. Once again, the common bundle cuts naturally take place solely when all layers of strips have covered their individual feed steps and have come to rest in their desired cutting position. All cutting lines are shown in dot dash line in FIG. 4 on the layers of strips 18.

In this way, all the security papers leaving the bundle-cutting unit 33 have a printed image located at least approximately in the frame and edges extending at right angles to each other, except for the last security papers of the layers of strips 18, whereof the rear edges in the direction S2, for reasons which were described earlier, extend approximately obliquely in the case of relatively great expansion of the printing plate, but which can be readily accepted since this small error which is only noticeable in the case of careful consideration, is much less conspicuous than the centering errors of the printed image tolerated hitherto. Therefore, the work involved in renewed trimming of these rear edges is not worthwhile, especially since for technical cutting reasons, trimming of this type is generally only possible in a troublefree manner if the waste strip has a width of at least approximately 2 mm.

In order to be able to control the afore-mentioned cutting angle $\alpha$ for the longitudinal cutting unit 25 automatically, it is necessary to measure a characteristic size for the expansion condition of the total printed image 11', i.e. for example the length of the boundary of this total printed image 11' adjacent the edge 16 of the sheet. As is quite clear, as the length of this printed image boundary increases, the angle $\alpha$ shown in FIG. 3 becomes greater according to a relationship which can be determined theoretically or/and empirically for a given type of printing plate. For measuring this dimension of the total printed image, in the example in question according to FIG. 3 amounting to approximately 4b+18y, for example a measuring unit 351 shown diagrammatically in FIG. 4 can be provided on the feed device 321, which respectively measures the sum of the four feed steps covered when cutting bundles from a layer of strips. This sum, thus in the example in question 4b+18y, corresponds to the required measurement of length, from which the cutting angle $\alpha$ can be derived on the basis of the afore-mentioned relationship. The measured value supplied by the measuring unit 351 is therefore supplied to an appropriately programmed mini-computer or microprocessor, which calculates the associated value of the angle $\alpha$ and emits a control command for the corresponding control of the cutting position of the longitudinal cutting unit 25. Naturally other methods are also possible for measuring the respective distortion condition of the total printed image 11' as well as for the automatic evaluation of the measurement results for the purpose of controlling the desired cutting angle.

According to a second way of carrying out the method for controlling the feed when cutting bundles, the reading units are dispensed with and the control is carried out by means of a mini-computer or microprocessor depending on the feed values respectively covered when cutting strips. In this case one makes use of the relationship which can be determined theoretically and/or empirically, which exists in the case of a given printing plate between its expansion in the longitudinal direction and in the transverse direction. If a characteristic expansion value in the direction F1 (FIG. 3) is known, then on the basis of this relationship, the corresponding expansion in the direction F2 can be calculated, or estimated at least with sufficient accuracy for the present purposes. One then requires a measuring unit 36 shown diagrammatically in FIG. 1, which is located on the feed device 26 and respectively measures one or more of the feed movements made by this feed device when cutting strips from a pile of sheets, as was already explained for the measuring unit 351 of the feed device 321. By way of example, it is thus sufficient to measure solely the feed length $D=D_o-d$ and thus the increasing change of length d of the sheets 10 and to feed this into the appropriately programmed mini-computer or micro-processor, which from the latter calculates all control commands, which are necessary for the afore-discussed, individual feed control of the individual layers of strips of the respective pile of sheets when cutting bundles. This second embodiment requires solely one reading unit 28 for reading the marks defining the strip cuts and for controlling the strip-cutting unit 27 as well as an appropriately programmed mini-computer or micro-processor, to which the measured feed lengths from the feed device 26 are fed as measured values and which controls the afore-described, individual feeds when cutting bundles. In this case, it also simultaneously preferably controls the adjustment of the longitudinal cutting unit 25 to the respective cutting angle $\alpha$, which likewise results from the afore-mentioned relationship or programming.

If the feed devices appropriately consist of the linear amplifiers mentioned in the introduction, then the measuring unit for measuring the feed movements made, may simply consist of a tachometer, which measures the number of revolutions carried out by the afore-mentioned stepping motor. In principle, a feed movement made by the feed device may naturally be determined in other ways, for example optically by measuring the distance covered by a pile of sheets or a layer of strips.

According to a third way of carrying out the method, by dispensing with printed marks and reading units, it is also possible to proceed in such a way that all feed movements are controlled by a computer both at the time of cutting strips as well as at the time of cutting bundles, to which computer a programme was fed which describes the increasing expansion of the respective printing plate as a function of the number of printing operations. The course of the expansion of a certain type of printing plate with the number of printing operations carried out can be determined mathematically and/or empirically or on the basis of empirical values and from this a complete programme for controlling the feed may be established.

The simplest way of carrying out the method consists according to a fourth embodiment in that the programmable feed devices 26 and 32 are set in a conventional manner firstly to the constant, original feed values $D_o$, a, $E_o$ and b and in the course of operation are re-programmed manually as soon as the centering error occurring becomes noticeable with the naked eye or begins to be troublesome. Thus, for example after 100,000 printing operations, that is to say after the passage of 1000 piles each with 100 sheets, the feed values originally set are varied by the correction values x or y described in detail with reference to FIGS. 2 to 4, in which case for example x=y=0.05 mm is chosen. The other correction quantities d of approximately 1 mm and the various $e_f$-corrections result from this. Changes of this type to the feed programming due to modification of the correction quantity x or y are then repeated several times by hand as the deformation of the printing plate increases, until the service life of the printing plate is exhausted. Thus, generally, the number of printing operations, after which the afore-mentioned correction quantities are varied by the step of 0.05 mm considered here, will not be constant, but will be chosen depending on the expansion of the printing plate generally increasing in a non-linear manner with the number of printing operations. The values of the respective correction quantities to be introduced can be determined in advance either from the course of the printing plate expansion known theoretically or empirically or, however, from case to case, by an inspection and measurement of the expanded printing plate or of the distorted outline of the total printed image of a sheet.

In general, the distortion effects produced by the expansion of the printing plates are less disturbing in the transverse direction than in the longitudinal direction (direction $F_o$), because namely the enlargement in the transverse direction takes place symmetrically towards both sides and therefore the security paper imprints in the central region of the sheet are displaced only relatively slightly towards one side and the other and the security paper imprints located laterally on the outside experience a displacement which corresponds solely to approximately half the overall enlargement of the total printed image 11'. On the other hand, the distortion effects in the individual rows of security papers 6 to 1 of a sheet are added together in the longitudinal direction, i.e. in the direction F1, as shown by the example according to FIGS. 2 and 3. For this reason, under certain circumstances it may be sufficient to use the afore-described feed correction solely when cutting strips and when cutting bundles, to operate with constant feeds, as normal.

Naturally, the correction possibilities described previously for cutting strips and cutting bundles may also be combined in any manner, for example so that the feed control when cutting strips takes place fully automatically, whereas the feed programme for cutting bundles is varied by hand according to requirements. Furthermore, it should generally be taken into consideration that the accuracy of centering of the security paper imprints within their border depends not solely on the expansion of the printing plates, but is subject to tolerances of varying magnitude, which emanate essentially from differences in the format of the security paper sheets, from the compression and expansion of the paper at the time of printing and from its moisture content as well as inaccuracies at the time of cutting. It would therefore be useless to introduce feed corrections which are more accurate than the afore-mentioned tolerances, to which the centering of the security paper imprints are subject for other reasons.

The afore-described examples relate to the cutting of sheets and layers of strips by individual cuts, which has the result that on account of the different feed steps, the format of the security papers produced is not constant, but varies to a small extent. However, this slightly different security paper format is in practice of little importance and in most cases is acceptable.

However, according to the method of the invention, security papers of constant format can also be readily produced if one works with intermediate cuts in manner known per se. An embodiment relating to this is described with reference to FIGS. 5 and 6. FIG. 5 shows a security paper sheet 110 with sixteen individual units 112, which are arranged in four security paper rows 101 to 104 each comprising four individual units. It is assumed that the die-stamping plate, which has printed this sheet, has experienced an appreciable expansion as in the example according to FIGS. 2 and 3, so that the outline 111' of the total printed image of all security paper imprints 113 is once more distorted in an approximately trapezoidal shape.

Those subsequent cutting lines, which despite this distortion, ensure approximate centering of the security paper imprints 113 within their border, are shown in broken line and chosen so that the format of all security papers 112 is always exactly the same size and has the dimensions a×b. For this, the widths of the intermediate strips located between the individual units vary, which strips are cut off subsequently as waste strips. The width of the intermediate strips Z1, Z2 and Z3 located between adjacent rows of security papers 101 to 104 thus decreases in the direction of the gripper edge 114 of the sheet exactly to the extent which was described in the example according to FIGS. 2 and 3 for the feed steps when cutting strips. If the original width of all intermediate strips Z1 to Z3 had the value f, then in the example considered according to FIG. 5, the widths now amount to f+3x, f+2x and f+x. The intermediate strips located between adjacent individual units of each row of security papers, which in FIG. 5 for the row of security papers 101 are designated by the reference numerals Z11, Z12 and Z13 and for the row of security papers 104 by the reference numerals Z41, Z42 and Z43, vary individually and in each row of security papers differently but in a similar manner like the feed steps of the individual layers of strips when cutting bundles, described with reference to the example according to FIGS. 3 and 4. When cutting a pile with the sheets 110, both the strip-cutting unit 27 as well as the bundle-cutting unit 33 are controlled so that those feeds which define the cutting lines in the case of a waste cut (i.e. when cutting off the front edge or an intermediate strip), are varied depending on the expansion of the printing plates, as described, whereas the other feeds, which define the cutting lines for cutting layers of strips or for the individual bundles of security papers, are programmed as fixed values and according to the desired format of security paper always amount to a or b.

For the automatic control of the feed, in the example according to FIG. 5, on the one hand printed marks m are once more provided on the side edge 117, which are read by the reading unit 28 for the purpose of controlling the feed when cutting strips and on the other hand printed marks n, which are printed on the intermediate strips between adjacent individual units of each row of security papers and are read by the reading units 341 to 344 (FIG. 6) for the purpose of controlling the feed when cutting bundles from the individual layers of strips 118. All the printed marks m and n define the widths of the front edges and intermediate strips to be cut off, which vary as a result of the expansion of the printing plates.

With a machine illustrated in FIG. 1, after the side edge 115 is cut off, as described previously, first of all the front edge 116 is cut off in the strip-cutting unit 27, in which case the feed into this cutting position is controlled by reading the first printed mark m by the reading unit 28. The length a of the following feed step into the cutting position necessary for the first strip cut is pre-programmed in a fixed manner. The feed into the following cutting position, in which the intermediate strip Z1 is cut off, is once more controlled by the reading unit 28 by reading the second printed mark m. This is followed by a feed step of the length a and so on.

The feed device 32 for the four layers of strips (118) belonging to one pile once more comprises feed devices 321 to 324 with their slides 311 to 314, associated individually with these layers of strips. The feed from the aligned initial position P2 into the first cutting position, in which the front edges of the layers of strips 118 are cut off, is controlled in a different manner individually for each layer of strips by the reading units 341 to 344, on reading the printed mark m of each layer of strips located respectively on the front edges. After cutting off the edge, each of the feed devices 321 to 324 carries out a fixed, programmed feed step of the length b, whereupon the foremost bundle of security papers of each layer of strips are cut off. The next feed is once more controlled by the reading units, individually for each layer of strips, on reading the respective mark n on the intermediate strips Z11, Z21, Z31 and Z41, whereupon these layers of strips are jointly cut off. This cut is followed by a fixed, programmed feed step of the length b, etc.

In this way security papers are produced whose security paper imprint is always centred at least approximately and which all have the same format, if one disregards the small inaccuracy which results for the respectively last bundles of security papers of the layers of strips as a result of trimming the side edge in the longitudinal cutting unit 25.

The afore-described processing of sheets of security papers with the assistance of intermediate cuts generally presupposes that the waste strips produced have a width of at least 2 mm, in order to ensure trouble free cuts.

By dispensing with the special printed marks m and n and with the reading units, the afore-described feed control may also be carried out when working with intermediate cuts, either according to a prepared programme changing as a function of the expansion of the printing plates or by hand, as was described for example according to FIGS. 2 to 4. Moreover, with a feed control by reading units, by dispensing with special printed marks m and n, characteristic points of the individual units, which can be recognized selectively by the reading units are used as natural marks, in particular the contrast at the boundary of the security paper imprint, as described earlier.

The method according to the invention may also be used on sheets of security papers, in which the strips are cut with individual cuts, whereas the bundles are cut with intermediate cuts. In this case, it is possible to work with printed marks m for cutting strips and printed marks n for cutting bundles, in which case it is ensured that the dimension b of the security paper format remains constant.

The invention is not limited to the embodiments described, but may have numerous variations. Thus, basically, if the side edge 17 of the sheet has no printed marks m for controlling the feed when cutting strips, both opposite side edges of the pile of sheets are cut simultaneously on the cutting section 24 before carrying out the strip cuts, in addition, the layers of strips belonging to one pile of sheets can be divided in succession into bundles of security papers, in which case the feed steps are varied in a different manner, one after the other individually for each layer of strips.

What is claimed is:

1. A method for manufacture of freshly printed security papers cut to format comprising the steps of:

printing security papers with a printing unit having a printing plate the printing step comprising printing a plurality of security paper units onto a sheet, the security paper units being arranged in the form of a matrix and wherein the sheets of security papers are laid on one another to form piles of sheets;

evaluating increasing expansion of the printing plate during the printing operation;

evaluating length of the feed movements, in a first direction, of a pile of printed sheets between a given initial position of a pile and a position in which trimming of the front edge of said pile takes place;

feeding a pile of sheets in a step-wise manner to a first cutter;

adjusting the length of the feed movements in the first direction for each cut in accordance with the increasing expansion of the printing plate in order to approximately maintain exact centering of the printed image with respect to the edge of the security paper;

cutting the pile of sheets in the first direction to form a plurality of piles of strips;

evaluating length of feed movement, in a second direction;

whereby the feed length is changing with the increasing number of prints such that centering of the print image with respect to the edge of the security paper is approximately maintained;

feeding at least one pile of strips in a step-wise manner to a second cutter;

adjusting the length of the feed movements in the second direction for each cut in accordance with the increasing expansion of the printing plate in order to approximately maintain exact centering of the printed image with respect to the cut edge of the security paper;

cutting the pile of strips in a second direction to form a plurality of bundles of security papers.

2. Method according to claim 1 further wherein: printing of the security papers comprises printing a plurality of security paper units onto a sheet, the security paper units being arranged in the form of a matrix and the sheet.

3. Method according to claim 1 wherein the sheets of security papers are laid on one another to form piles of sheets and the piles of printed sheets are fed stepwise and cut into layers of strips.

4. Method according to claim 3 wherein the layers of strips are then cut into bundles of security papers.

5. Method according to claim 4 further comprising the steps of: cutting the strips parallel to the gripper edge of the sheets; locating the gripper edge at the rear in the feed direction; feeding the pile of sheets from an initial position to a trimming position wherein the feeding length to the trimming position is reduced with respect to an initial value corresponding to an undeformed printing plate, as the expansion of the printing plate increases; feeding the strips in a first step to the cutter so that the first feed step, which determines the width of the first layer of strips or of the first waste strip produced with intermediate cuts are increased with respect to an initial value corresponding to an undeformed printing plate; and reducing the length of the successive feed steps, which determine the width of the following layers of strips or waste strips; in comparison to the first feed step, in accordance with the increased expansion of the printing plate.

6. A method accordingly to claim 4 further comprising the steps of:

cutting the bundle cuts at right angles to the gripper edge; increasing the respective first feed step which determines the dimensions of a first bundle of security papers or of first waste strips produced with intermediate cuts, with respect to an initial value corresponding to the undeformed printing plate; as the expansion of the printing plate increases; and reducing the length of the respective feed steps in comparison to the first feed step until a control region of the sheet is reached, then increasing the length of the feed steps.

7. Method according to claim 6 comprising the steps of:

cutting a side edge of the sheets or of the layers of strips which are oriented at right angles to the gripper edge along a cutting line which extends approximately parallel to the adjacent lateral boundary of the total printed image on the sheet, the cutting line, with increasing expansion of the printing plate, enclosing with the gripper edge an angle increasing beyond 90°; reducing the length of feed of the layers of strips from a given initial position, which is defined by the position and alignment of the afore-mentioned outside edges, to that position in which the trimming of the front edge of the layer of strips in the bundle unit takes place, with regard to the initial value corresponding to the undeformed printing plate; and reducing the feed length for the succeeding layers of strips, to further the respective layer of strips is located from the layer of strips adjacent the gripper edge.

8. A method for the manufacture of freshly printed security papers according to claim 1 wherein:

evaluation of the feed movements in the first direction is according to the formula $$D=D_o-d;$$

evaluation of the feed movements in the second direction is according to the formula $$E=E_o-e,$$

the values of "d" and "e" changing with the increasing number of prints; and wherein D is the length of the feed movement in the first direction, $D_o$ is a preset constant feed distance, and d is a correction factor for each feed stroke in the first direction, and wherein E is the length of the feed movement in the second direction, $E_o$ is a preset constant feed distance, and e is a correction factor for each stroke in the second direction.

9. Method according to claim 1, further comprising the step of: providing intermediate cuts at least when cutting bundles and varying only the length of the feed movements which determine the size of the waste strips, depending on the increasing expansion of the printing plates, and maintaining constant length of the feed movements which determine the format of the security papers.

10. A method according to claim 1, characterized in that the bundle cuts take place at right angles to a gripper edge and that the respective first feed steps, which determine the dimensions of the first bundle of security papers or of the first waste strips produced with intermediate cuts, when cutting the layers of strips, are increased with respect to the initial value corresponding to the undeformed printing plate, as the expansion of the printing plate increases and the remaining feed steps, which when cutting a layer of strips determine the dimensions of the following bundles of security papers or waste strips, are reduced in comparison to the first feed step first of all as far as cuts in the central region of a layer of strips and then are once more increased, in which case for all layers of strips belonging to one and the same pile of sheets, the feed steps corresponding to one another are chosen to be all the greater the further the respective layer of strips from the layer of strips adjacent the gripper edge of the sheets, wherein the gripper edge is located at the rear in the feed direction.

11. Method according to claim 1, characterised in that before cutting the bundles, a side edge of the sheets or of the layers of strips orientated at right angles to the gripper edge is cut along a cutting line, which extends at least approximately parallel to the adjacent lateral boundary of the total printed image on the sheet and therefore with increasing expansion of the printing plate encloses with the gripper edge an angle increasing beyond 90° and that the length of the feed of the layers of strips from a given initial position, which is defined by the position and alignment of the afore-mentioned cut side edges, to that position in which the trimming of the front edge of the layer of strips in the bundle-cutting unit takes place, is reduced with regard to the initial value corresponding to the undeformed printing plate, as the expansion of the printing plate increases, in which case for all layers of strips belonging to one and the same pile of sheets, the afore-mentioned feed length is chosen to be all the smaller, the further the respective layer of strips is located from the layer of strips adjacent the gripper edge.

12. Method according to claim 11 further comprising assembling all layers of strips belonging to one and the same pile of sheets one beside the other in their initial position, moving the layers of strips forwards jointly to the bundle-cutting unit and cutting the layers of strips simultaneously at this point step-wise into bundles of security papres, wherein the feed length to the bundle-cutting unit and the individual feed steps when cutting bundles are adjustable and controllable separately and in a different manner for each individual layer of strips.

13. Method according to claim 12, further comprising readjusting by hand the lengths of the feed movements respectively after the passage of a certain number of piles of sheets.

14. Method according to claim 12, further comprising controlling the lengths of the feed movements by means of a programme adapted to the increasing expansion of the printing plate.

15. Method according to claim 12, further comprising printing at least one side edge of the sheets orientated parallel to the feed direction of the pile of sheets, when cutting strips, which is cut off at the time of subsequent trimming, with edge marks provided on the printing plate, during printing of the sheets, which marks define the position of subsequent strip cuts or waste cuts; and automatically controlling the length of the feed movements producing guidance into these cutting positions as a function of these edge marks read by a reading unit.

16. Method according to claim 15, further comprising automatically measuring and storing the lengths of the variable feed movements carried out when cutting strips, by means of a program so that at the time of subsequent cutting of bundles from the respective layers of strips, the feed lengths to be varied are controlled automatically as a function of these stored values on the basis of a programme fed into the computer, which forms a relationship between the expansion of the printing plate in the longitudinal direction and the expansion in the transverse direction.

17. Method according to claim 15, further comprising: providing intermediate cuts at least when cutting bundles and during printing of the sheets, whereby those regions which are cut off as waste strips at the time of the subsequent intermediate cuts are printed with marks located on the printing plate, which marks define the position of the subsequent intermediate cuts; and automatically controlling the lengths of the feed movements, which determine the width of the waste strips, as a function of these marks read by reading units.

18. Method according to claim 17, further comprising: applying two individual marks per cutting line as edge marks or marks to the subsequent waste strips so that reading of the first individual mark in the feed direction brings about a reduction of the normal feeding speed to a creeping movement and reading of the second individual mark stops the feed movement.

19. Method according to claim 12, further comprising controlling the lengths of the feed movements to be varied by detectors, which respond to similar, selected characteristic points in each security paper imprint, such as patterns, coloured marks or contrasts, in particular to the contrast between the light border of the security paper and a dark region of the security paper imprint.

* * * * *